United States Patent [19]

Todd

[11] Patent Number: 4,814,748

[45] Date of Patent: Mar. 21, 1989

[54] TEMPORARY DESENSITIZATION TECHNIQUE FOR SMOKE ALARMS

[75] Inventor: Carl D. Todd, Costa Mesa, Calif.

[73] Assignee: Southwest Laboratories, Inc., Costa Mesa, Calif.

[21] Appl. No.: 118,734

[22] Filed: Nov. 9, 1987

[51] Int. Cl.[4] ..... G08B 23/00; G08B 17/10

[52] U.S. Cl. ..... 340/527; 340/628; 340/309.15

[58] Field of Search ..... 340/527, 529, 530, 628, 340/629, 630, 691, 693, 309.15, 309.3, 309.4

[56] References Cited

U.S. PATENT DOCUMENTS

| | | | |
|---|---|---|---|
| 3,594,751 | 7/1971 | Ogden et al. . | |
| 3,688,293 | 8/1972 | Sullivan . | |
| 3,775,761 | 11/1973 | Kobayashi et al. . | |
| 4,313,110 | 1/1982 | Subulak et al. | 340/527 |
| 4,383,251 | 5/1983 | Perelli et al. | 340/527 |
| 4,524,281 | 6/1985 | Muggli et al. | 340/630 |
| 4,556,873 | 12/1985 | Yamada et al. | 340/630 |
| 4,692,750 | 9/1987 | Murakami et al. | 340/506 |

OTHER PUBLICATIONS

Product Description Bulletin DS9812 for "MC14466 Low-Cost Smoke Detector," Motorola Semiconductor Products Inc., 1980.

*Primary Examiner*—Donnie L. Crosland

*Attorney, Agent, or Firm*—Knobbe, Martens, Olson & Bear

[57] ABSTRACT

A smoke alarm having a detector circuit for detecting smoke and producing a sensible signal in response to such detected smoke is provided with a manually actuated control which cooperates with the smoke detector circuit temporarily desensitize the smoke detector circuit and later to automatically re-sensitize the smoke detector circuit after expiration of a predetermined interval. A user is thus able to desensitize the smoke detector circuit to false alarming due to lower level concentrations of smoke, such as are produced during cooking, smoking, etc., while maintaining responsiveness and protection against higher concentrations of smoke, such as would result from an actual fire condition.

14 Claims, 4 Drawing Sheets

TEMPORARY DESENSITIZATION TECHNIQUE FOR SMOKE ALARMS

FIELD OF THE INVENTION

This invention relates generally to smoke detecting alarms and, particularly, to techniques for temporary desensitization of alarm function during periods of non-fire, low level ambient smoke conditions.

BACKGROUND OF THE INVENTION

There are many types of smoke detecting alarm systems commonly in use today. One of the most common uses is for protection of residential dwellings. An exemplary conventional home smoke alarm system consists of a relatively small, self-contained, electrically operated smoke detector unit. This unit can easily be mounted in locations where fires are most likely to occur, such as in kitchens and utility areas, and in areas where maximum protection is required, such as in hallways and in sleeping quarters.

The widespread use of smoke alarms has unquestionably resulted in a great savings of both lives and property. This common usage, however, has created several inconveniences which are at least annoying, and which discourage the use of such alarms by many persons. One of the most significant inconveniences involves false triggering of the alarm. It has been found that cooking smoke may set off the alarm, as well as smoke generated by other non-fire sources such as a large number of smokers in a single room. Additionally, some types of smoke detectors are triggered by heavy concentrations of water vapor in the air, such as can be produced by showering or bathing.

Repeated false alarms triggered in this manner are both inconvenient and annoying, and may have the further effect of inducing the user to fully disable the alarm, such as by removing the battery. Since the user will often refuse or forget to reactivate the alarm when the offending source is eliminated, any safety benefits from its use are eliminated.

In an effort to solve this type of problem, a smoke alarm device has been invented which is capable of being temporarily deactivated, to enable the user to cook, smoke or bathe without further concern for false alarming of the detector. One such device is disclosed in U.S. Pat. No. 4,313,110 to Subulak, et al.

The method of disabling the detector disclosed in U.S. Pat. No. 4,313,110 consists of temporarily removing power to the alarm circuitry. The apparatus includes an independent timing circuit that is utilized to control the disabling function. A temperature responsive switch is also provided to override the disabling function should the temperature rise as the result of an actual fire.

OBJECTS OF THE INVENTION

It is an object of the present invention to provide a smoke alarm system which avoids the problems of false triggering, mentioned earlier, associated with known commercially-available smoke alarms.

It is a further object of the present invention to provide a smoke detection system capable of being temporarily desensitized to lower level ambient smoke conditions, while maintaining detection and alarm capability in conditions of high smoke concentrations, caused by an actual fire.

It is still a further object of the present invention to provide a method of achieving these objectives by utilizing currently available and widely used commercial components, with the addition of a minimal number of additional components, thus reducing manufacturing costs and maximizing reliability.

SUMMARY OF THE PRESENT INVENTION

The present invention provides for an electrically powered smoke alarm having a housing and a smoke detector circuit internal to the housing to monitor the concentration of smoke in the air in proximity to the detector. The smoke alarm produces a sensible signal in response to any smoke detected in excess of a predetermined concentration. The present invention further provides a control circuit electrically connected to and cooperating with the smoke detector circuit, which serves to selectably desensitize the smoke detector circuit such that no sensible alarm signal will be produced in response to the initial predetermined concentration of smoke, but such that a sensible signal will be produced in response to a second concentration of detected smoke, with the second concentration in excess of the first (initial) concentration.

The present invention further provides that the sensitivity of the detector will be automatically restored to its initial level after a predetermined time so that a sensible signal can again be produced in response to any detected smoke in concentrations in excess of the first (lower) level.

These unique features are provided by the addition of a small number of electronic components to existing commercially-available and widely used electronic components. This results in the incorporation of the desensitization function at minimum manufacturing costs while maximizing reliability of the device.

The present invention provides a fire alarm device which avoids the annoyances and inconveniences associated with false triggering of current smoke alarm systems. This is accomplished without the need for temporary periods of complete inhibition of smoke detecting functions by providing continuous protection at a lower sensitivity level of the smoke detector. Thus, the alarm is not triggered during non-fire smoke generating activities, such as cooking, smoking or bathing.

BRIEF DESCRIPTION OF THE DRAWINGS

These and other objects, features and advantages of the present invention should become apparent from the following description when taken in conjunction with the accompanying drawings in which.

DESCRIPTION OF THE PREFERRED EMBODIMENT

Description of the Operation of the Integrated Circuit

The current invention is intended to cooperate with a commercially available smoke detector circuit, such as the Motorola MC14466 integrated circuit or the Motorola MC14467 integrated circuit. Operation of the MC14466 integrated circuit is briefly described herein, while a full description is contained in Motorola Semiconductor Products Inc. Product Description Bulletin No. DS9812, which is incorporated by reference herein.

Figure 1:
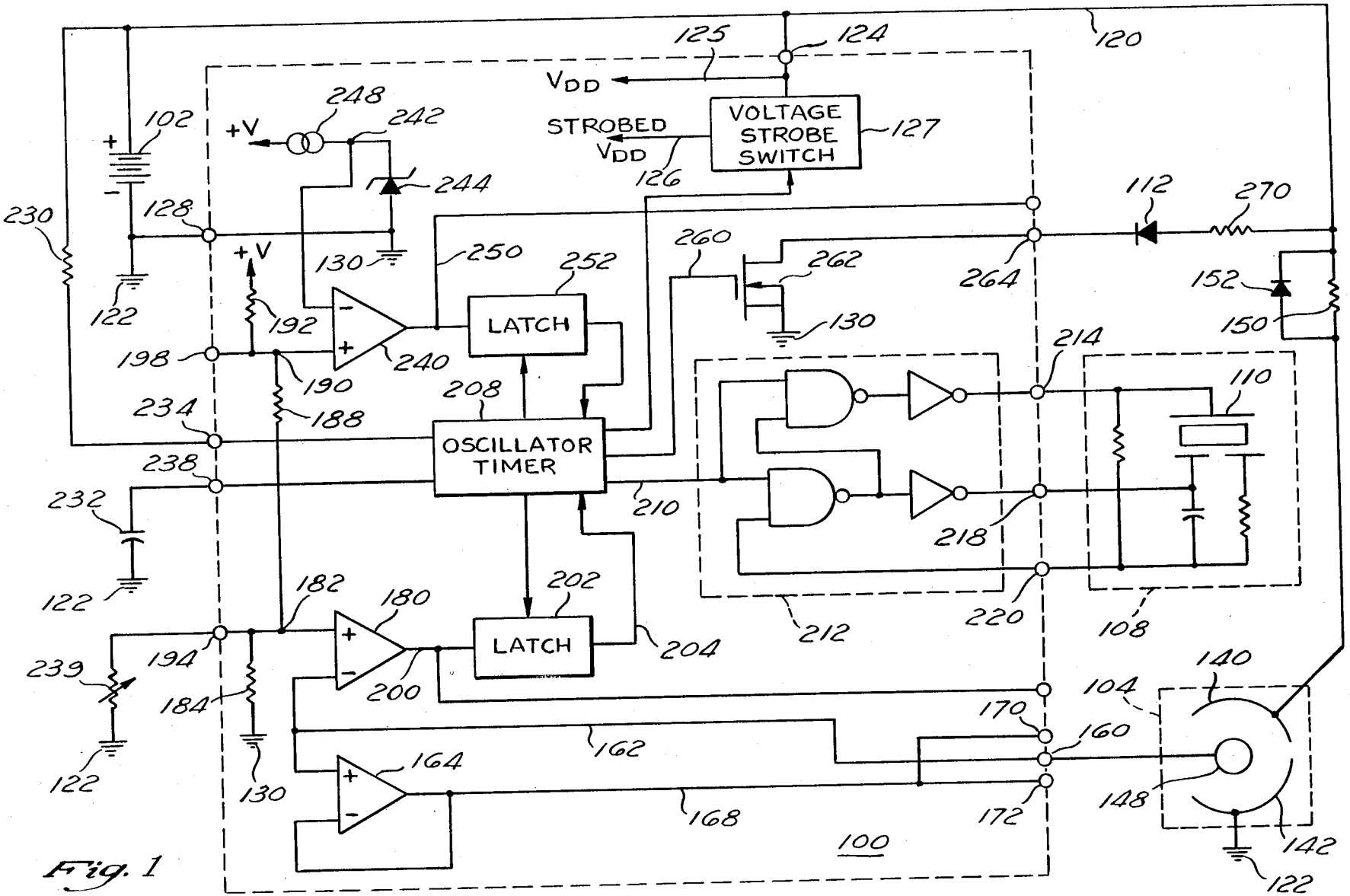
FIG. 1 is a schematic diagram of a conventional Motorola MC14466 smoke detector integrated circuit whose internal circuitry is shown in block diagram form.

FIG. 1 is a schematic diagram of the electrical circuitry for an exemplary conventional smoke detector unit incorporating the MC14466 integrated circuit whose inner circuit is shown in block diagram form. The smoke detector unit comprises an integrated circuit 100, such as a Motorola MC14466 integrated circuit, a Motorola MC14467 integrated circuit, or an equivalent. (The Motorola MC14466 integrated circuit will be described hereinafter.) The integrated circuit 100 is powered by a battery 102, such as a 9-volt alkaline battery, although AC electrical sources driving a suitable selectable DC power supply (e.g., an AC-to-DC converter) could also be used. The integrated circuit 100 is electrically connected to an ionization chamber 104 that detects the presence of smoke or other particles in the air in proximity to the ionization chamber 104. The integrated circuit 100 is further connected to an alarm output circuit 108, which, in the embodiment shown, includes a piezoelectric horn 110 to supply a sensible (e.g., audible) signal to the user. The integrated circuit 100 further drives a light-emitting diode 112. Typically, the electronic circuitry of the smoke detector unit illustrated in FIG. 1 is packaged as a single unit that is readily mountable to the ceiling or wall of a home or other building. The operation of the electronic circuitry of FIG. 1 will be briefly described hereinafter.

The battery 102 provides the electrical power for the smoke detector unit of FIG. 1. The battery has a positive terminal (+) that is connected to a positive voltage bus 120 and a negative terminal (−) this is connected to an external ground reference 122. The positive voltage bus 120, which also serves as a positive voltage reference, is electrically connected to a power input connection pin 124 of the integrated circuit 100. In the exemplary MC14466 integrated circuit 100, the electrical power provided on the positive voltage bus 120 is supplied to some portions of the integrated circuit 100 on a continual basis via an internal voltage bus ($V_{DD}$) 125 and to other portions of the integrated circuit 100 only on a periodically strobed basis via a strobed voltage bus (STROBED $V_{DD}$) 126. The strobing of the voltage supply to the selected portions of the integrated circuit 100 conserves the electrical energy provided by the battery 102. The voltage on the strobed voltage bus (STROBED $V_{DD}$) 126 is provided by an internal voltage strobe switch circuit 127 that is periodically enabled and disabled. When the voltage strobe switch circuit 127 is enabled, power is applied to the STROBED $V_{DD}$ bus 126 to enable the smoke detection circuitry, as will be described below.

The details of the operation of the voltage strobe switch circuit 127 and the identities of the specific portions of the circuitry within the integrated circuit 100 that are connected to the strobed voltage bus (STROBED $V_{DD}$) 126 rather than the non-strobed internal voltage bus ($V_{DD}$) 125 are proprietary to the manufacturer. Thus, voltage connections within the integrated circuit 100 are shown as +V, rather than specifying which of the two voltage buses is connected to a particular portion of the integrated circuit.

A ground return connection pin 128 of the integrated circuit 100 is connected to the external ground reference 122. The ground return connection pin 128 of the integrated circuit 100 is connected internally to an internal ground reference 130.

The ionization chamber 104 includes a first outer electrode 140, a second outer electrode 142, and an inner electrode 148. The ionization chamber 104 may also include a guard ring; however, no guard ring is shown in the embodiments described herein. The first outer electrode 140 is connected via a resistor 150 to the positive voltage bus 120. A diode 152 is electrically connected across the resistor 150, with its cathode connected to the first outer electrode 140 and its anode connected to the positive voltage bus 120. The second outer electrode 142 is connected to the external ground reference 122. Thus, a voltage potential is provided between the first outer electrode 140 and the second outer electrode 142. The ionization chamber 104 further includes a low-level radiation source (not shown) that ionizes the air within the ionization chamber 104 and permits a small current to flow from the first outer electrode 140 to the second outer electrode 142 in response to the voltage potential between the first outer electrode 140 and the second outer electrode 142. The inner electrode 148 is positioned within the chamber to sense a voltage with respect to the external ground reference 122 that is responsive to the amount of current flowing between the first outer electrode 140 and the second outer electrode 142. As is well known in the art, the amount of current flowing between the first and second outer electrodes 140, 142 depends upon the concentration of particles in the air in proximity to and thus within the ionization chamber 104. For example, if the concentration of the particles increases, the amount of current flowing between the first and second outer electrodes 140, 142 will decrease, causing a consequent decrease in the voltage sensed by the inner electrode 148.

The inner electrode 148 of the ionization chamber 104 is electrically connected to the integrated circuit 100 via a connection pin 160. Within the integrated circuit 100, the connection pin 160 is electrically connected via a line 162 to the non-inverting input of a buffer amplifier 164. The buffer amplifier 164 has an output on a line 168 that is electrically connected to a first guard ring output pin 170 and to a second guard ring output pin 172 of the integrated circuit 100, which are connectable to a guard ring (not shown) of the ionization chamber 104. The embodiments described herein do not use this feature. The output of the buffer amplifier circuit 164 on the line 168 is also connected to the inverting input of the buffer amplifier 164 to provide unity negative feedback and thus provide an output voltage on pins 170, 172 which is within 100 millivolts of the chamber output voltage from inner electrode 148. Tis voltage can be advantageously monitored for testing purposes.

The line 162 within the integrated circuit 100 is also electrically connected to the inverting input of an ionization voltage sensing comparator 180. The ionization voltage sensing comparator 180 has a non-inverting input that is connected to a first node 182 of an internal voltage divider network. The internal voltage divider network comprises a first voltage divider resistor 184 that is connected between the first voltage divider node 182 and the ground reference 130; a second voltage divider resistor 188 that is connected between the first voltage divider node 182 and a second voltage divider node 190; and a third voltage divider resistor 192 that is connected between the second voltage divider node 190 and the positive voltage input pin 124. The first voltage divider node 182 is further connected to a first sensitivity adjustment input pin 194. The second voltage divider node 190 is further connected to a second sensitivity battery adjustment pin 198. The voltage on the first voltage divider node 182 is determined by the voltage of the battery 102, and the relative resistances of the three voltage divider resistors 184, 188 and 192. In accordance with the information provided by Motorola, in an exemplary Motorola MC14466 integrated circuit, the first voltage divider resistor 184 has a resistance of approximately 1.125 megohms, the second voltage divider resistor 188 has a resistance of approximately 1.045 megohms, and the third voltage divider resistor 192 has a resistance of approximately 80,000 ohms.

Under normal conditions (i.e., substantially no smoke), the voltage sensed by the inner electrode 148 of the ionization chamber 104 is greater than the voltage on the first voltage divider node 182. Thus, during a strobe pulse, the voltage on the inverting input of the ionization voltage sensing comparator 180 will be greater than the voltage on the non-inverting input of the ionization voltage sensing comparator 180, as provided by the first voltage divider node 182, and therefore, the output of the ionization voltage sensing comparator 180 on a line 200 will be low (i.e., inactive) when the concentration of smoke particles in the ionization chamber 104 is low.

When the concentration of smoke or other particles within ionization chamber 104 increases sufficiently to reduce the voltage on the inner electrode 148 sufficiently below the voltage on the first voltage divider network node 182 during one of the strobe pulses, the output of the ionization voltage sensing comparator 180 will change states. This change in state is sensed by a smoke sensing latch 202.

The smoke sensing latch 202 provides an output signal on a line 204 that is provided as an input to an oscillator/timer circuit 208. This output signal, when active, increases the rate of the internal oscillator/timer. The oscillator/timer circuit 208 then provides an output voltage on a line 210 to a horn driver circuit 212 that provides outputs on horn driver output connector pins 214, 218, and has a feedback input on a horn driven input pin 220. The piezoelectric horn circuit 108 is electrically connected to the connector pins 214, 218 and 220. When the signal on the line 210 is activated, the horn driver circuit 212 causes the piezoelectric horn 110 to sound, producing a sensible signal to indicate the detection of the smoke condition.

The piezoelectric horn 110 is sounded intermittently at a rate determined by the rate at which the signal on the line 210 is applied to the driver circuit 212. This, in turn, is determined by a timing resistor 230 and a timing capacitor 232. One terminal of the timing resistor 230 is connected to the oscillator/timer circuit 208 via a first timer connector pin 234. The other terminal of the timing resistor 230 is connected to the positive voltage bus 120. One terminal of the timing capacitor 232 is connected to the oscillator/timer circuit 208 via a second timer connector pin 238, and the other terminal of the timing capacitor 232 is connected to the external ground reference 122.

The sensitivity of the Motorola MC14466 integrated circuit can be selectably adjusted by electrically connecting an external variable sensitivity adjustment resistor 239 between the first sensitivity adjustment pin 194 and the external ground reference 122. This has the effect of lowering the voltage on the first voltage divider node 182 and thus selectably increasing the concentration of particles required to initiate an alarm condition. The external sensitivity adjustment resistor 239 can thus be used to compensate for differences between the characteristics of the internal voltage divider network for various integrated circuits and to compensate for differences in the characteristics of the ionization chamber 104.

The integrated circuit 100 further includes a battery voltage level sensing comparator 240 that has a non-inverting input connected to the second voltage divider node 190 and has an inverting input connected to a constant voltage reference node 242. The constant voltage reference node 242 provides a constant voltage that is determined by an internal avalanche diode 244 that is provided with current through a current source 248. When the voltage on the second voltage divider node 190 decreases below the voltage on the constant voltage reference node 242, the output of the battery voltage level sensing comparator 240 on a line 250 will become active, and the condition will be sensed by a battery voltage level latch 252.

The battery voltage level latch 252 provides an output signal on a line 254 that is provided as an input to the oscillator/timer circuit 208. As set forth above, the oscillator/timer circuit 208 provides an output signal on the line 210 to the piezoelectric horn driver circuit 212 to drive the piezoelectric horn 110 to produce a sensible signal. However, when the oscillator/timer circuit 208 responds to the signal from the battery voltage level latch 252, the oscillator/timer circuit 208 drives the piezoelectric horn 110 at a different rate (e.g., a slower rate) so that a person hearing the operation of the piezoelectric horn 110 can differentiate the signal thus generated from the signal indicating a smoke condition. This signal is intended to indicate to the listener that the condition of the battery 10 has deteriorated and that the battery 102 should therefore be replaced.

In order to further test the condition of the battery 102, the oscillator/timer circuit 208 provides an output signal on a line 260 that is connected to the gate of a field effect transistor 262. The field effect transistor 262 operates as a semiconductor switch between an output driver pin 264 and the internal ground reference 130. In the exemplary circuit in FIG. 1, the output pin 264 is electrically connected to the cathode of the light-emitting diode (LED) 112 that has its anode electrically connected via a resistor 270 to the positive voltage bus 120. When the signal on the line 260 is active, an electrical current path is provided between the output pin 264 and the internal ground reference 130. Thus, when the field effect transistor 262 is activated, current will flow through the LED 112 causing it to emit light. This serves a two-fold purpose of indicating to an observer that the smoke detector unit is still operational, and to provide a periodic increase in the current drawn from the battery 102, to test the series impedance of the battery 102. For example, when the extra current flows through the LED 112, the voltage on the positive voltage bus 120 may drop because of the series impedance of the battery 102. If the voltage drops sufficiently such that the voltage on the second voltage divider node 190 is less than the voltage on the constant voltage reference node 242, the low battery voltage indication will occur. In exemplary smoke detector units utilizing the Motorola MC14466 integrated circuit 100, the timing circuit is set so that the LED 268 is activated once every 40 seconds, and thus the battery is tested once every 40 seconds, causing the piezoelectric horn 110 to sound every 40 seconds when the battery 102 has deteriorated.

The Motorola MC14466 integrated circuit 100 used in the exemplary smoke detector unit described in FIG. 1 also utilizes the oscillator/timer circuit 208 to strobe the power applied to the ionization voltage sensing comparator 180, the battery voltage level sensing comparator 240, and the latches 202, 252, such that power is applied to the circuits for only approximately 10 milliseconds out of every 1.67 seconds, assuming a recommended timing resistor of 8.2 megohms, and a timing capacitor of 100 nanofarads are used. The power strobing function is provided by the voltage strobe switch circuit 127 that is periodically activated by the oscillator/timer circuit 208 to apply a positive DC voltage to the STROBED $V_{DD}$ bus 126. After smoke is sensed, the strobe rate is increased to once each 40 milliseconds, or 25 hertz. Thus, the life of the battery 102 is greatly extended by reducing the total power requirements.

As set forth in the Background of the Invention, a circuit constructed in accordance with FIG. 1 has the disadvantage that the sensitivity is typically set for low-level concentrations of smoke so that a fire can be detected in its early stages. As set forth above, this sensitivity is determined by the voltage on the first voltage divider node 182. Although such circuits operate quite well and are in common use in households and businesses throughout the country, there are a number of situations wherein the fixed level of sensitivity is inconvenient at best and a potential hazard. For example, when a smoke detector unit, such as described above in connection with FIG. 1, is used in a kitchen or other areas where low-level concentrations of particles can be expected, such as smoke or water vapor from cooking, an alarm having a fixed sensitivity will tend to sound frequently. This, of course, has a number of disadvantages, including the annoyance of having to listen to the alarm until the low-level smoke condition clears. It also has the further disadvantage that the sounding of the alarm draws a substantial amount of current compared to that drawn during the normal (i.e., non-alarm) condition. Thus, frequent sounding of the alarm can drain the battery. As set forth above, a person subjected to the alarm condition may remove the battery or otherwise turn the unit off to avoid listening to the alarm and either forget to replace the battery or deliberately decide not to replace the battery. In either case, the smoke alarm unit would no longer operate.

As set forth above, U.S. Pat. No. 4,313,110 suggests an embodiment wherein the power applied to a smoke detector is temporarily disconnected via a relay for a predetermined amount of time upon activation of a switch. This has the advantage of reactivating the alarm after the predetermined amount of time and avoids the problems associated with removal of the battery. On the other hand, since cooking is often the cause of an actual fire as well as the low-level concentrations of smoke described above, particularly when the cook leaves the kitchen to perform other errands, it is undesirable to leave the kitchen area unprotected throughout the predetermined time that the smoke alarm is disabled. The present invention provides a compromise between the annoyance of an alarm condition at low-level concentrations and the complete absence of protection.

DESCRIPTION OF THE PRESENT INVENTION

Figure 2:
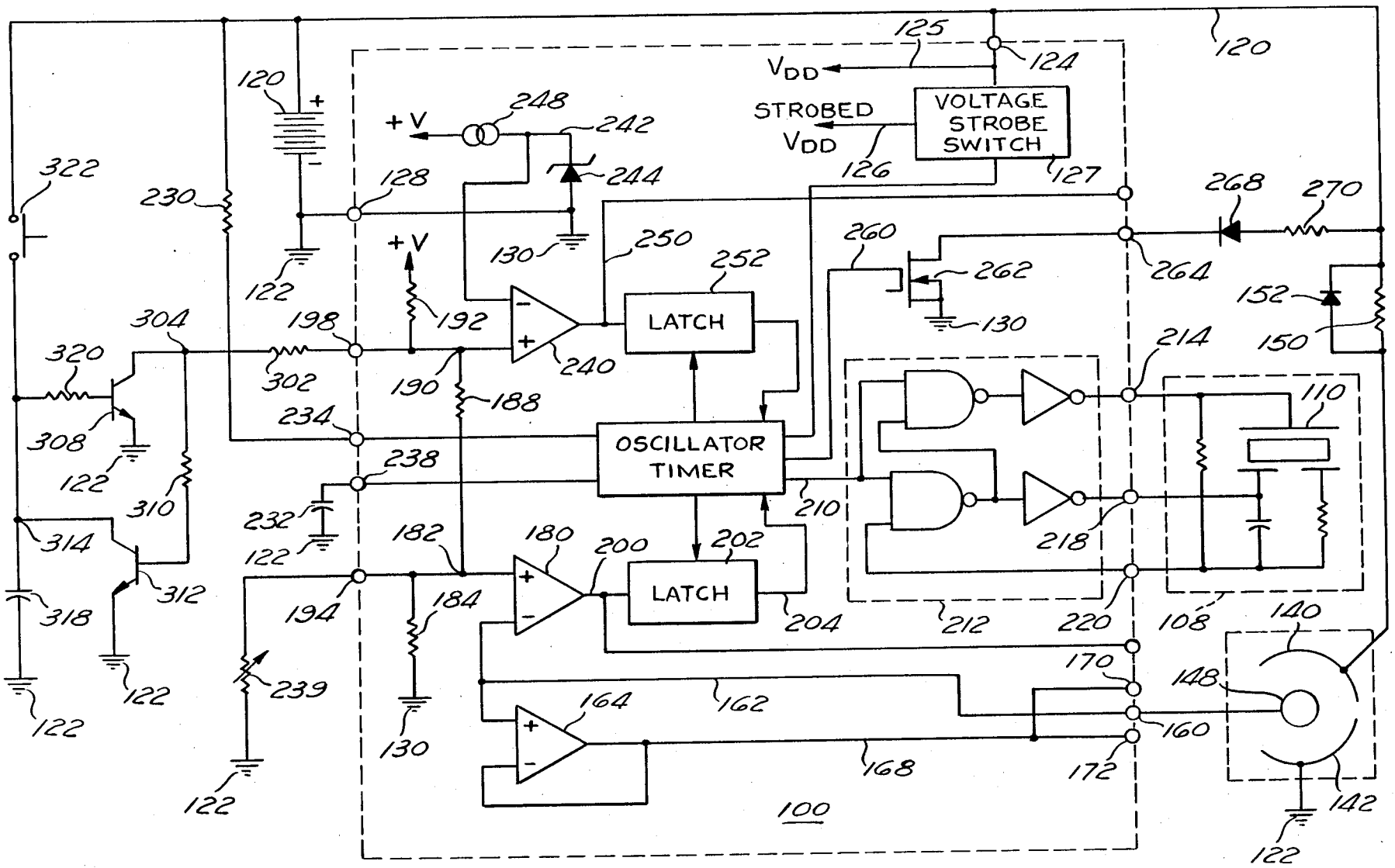
FIG. 2 is a schematic circuit diagram of a preferred embodiment of the present invention that incorporates the Motorola integrated circuit into an alarm having a timed desensitization circuit.
Figure 5:
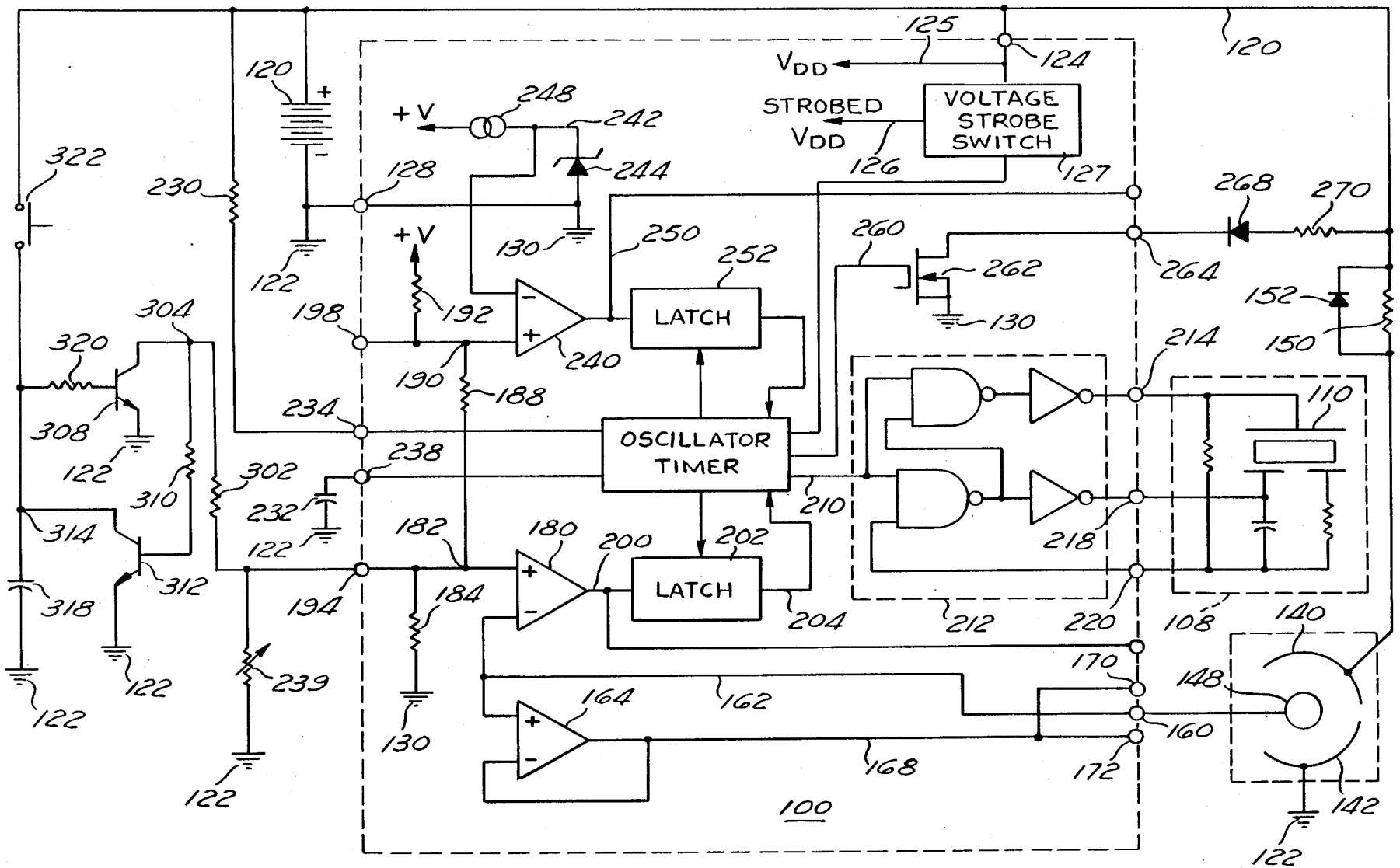
FIG. 5 is a schematic circuit diagram of a second preferred embodiment of the present invention that incorporates the Motorola integrated circuit into an alarm having a timed desensitization circuit.

Two alternative preferred embodiments of the present invention will be described below. One is shown in FIG. 2 and the other is shown in FIG. 5. Both embodiments incorporate the novel feature of temporarily reducing the sensitivity of the detector circuitry so that the audible signal is not sounded when low concentrations of smoke are present, while permitting continued protection against higher concentrations of smoke. In the embodiment shown in FIG. 2, this function is accomplished by accessing the second battery sensitivity adjustment pin 198. In the embodiment shown in FIG. 5, this function is accomplished by accessing the voltage divider network via the first sensitivity adjustment pin 194. In both embodiments, the voltage on the first voltage divider node 182 is decreased to temporarily decrease the sensitivity of the detector circuitry. Both the operation and connection of the various elements of the preferred embodiments of the present invention are described hereinafter. Due to the similarities between the preferred embodiment of FIG. 2 and that of FIG. 5, the embodiment of FIG. 2 will be described first in detail, and then the embodiment of FIG. 5 will be described.

In FIG. 2, the sensitivity adjustment resistor 239 is electrically connected between the first sensitivity adjustment pin 194 and the external ground reference 122, as before. A second sensitivity adjustment resistor 302 is electrically connected between the second sensitivity adjustment pin 198 and a first external node 304. A first NPN transistor 308 has its collector connected to the first external node 304 and has its emitter connected to the external ground reference 122. A third sensitivity adjustment resistor 310 is electrically connected between the first external node 304 and the base of a second NPN transistor 312. The emitter of the second NPN transistor 312 is connected to the external ground reference 122. The collector of the second NPN transistor 312 is connected to a second external node 314. A sensitivity timing capacitor 318 has one of its terminals connected to the second external node 314 and has its other terminal connected to the external ground reference 122. A fourth sensitivity adjustment resistor 320 is electrically connected between the second external node 314 and the base of the first NPN transistor 308. The second external node 314 is also connected to one contact of a normally open, momentary contact switch 322, which can advantageously be a pushbutton switch. The switch 322 has a second contact which is electrically connected to the positive voltage bus 120. When the switch 322 is manually activated, the voltage on the positive voltage bus 120 is applied to the second external node 314 and thus to the capacitor 318, causing the capacitor 318 to be charged to the voltage of the positive voltage bus 120 (e.g., 9 volts). The operation of the external sensitivity adjustment circuit is described hereinafter.

In the normal mode of operation of the alarm circuitry, the switch 322 is left in the open position. The capacitor 318 will be substantially discharged (i.e., approximately zero volts across the terminals) and the voltage on the second external node 314 will thus be at or very near the potential of the external ground reference. There will, therefore, be no significant current flow through the fourth sensitivity adjustment resistor 320 into the base of the first NPN transistor 308. The first NPN transistor 308 will thus be in the cutoff condition, with no substantial current flowing between the collector and emitter. The first external node 304 will be near or slightly lower than the voltage of the second voltage divider node 190 on the second sensitivity adjustment pin 198. As a result, the second NPN transistor 312 will be driven into saturation with the base current limited by the third sensitivity adjustment resistor 310 and the second sensitivity adjustment resistor 302. The voltage at the second external node 314 will thus be pulled very nearly to the potential of the external ground reference 122 through the collector and emitter of the second NPN transistor 210. (The actual voltage will be determined by the collector-emitter saturation voltage of the second NPN transistor 312, and will typically be less than 0.2 volts, generally around 3 millivolts, depending mostly on the inverse DC current gain of transistor 312.) The resistance of the third sensitivity adjustment resistor 310 is selected so that the current flowing into the base of the second NPN transistor 210 has little effect on the internal voltage divider network. For example, in one preferred embodiment, the resistance of the third sensitivity adjustment resistor is 10 megohms.

While in the preferred embodiment of FIG. 2, both the alarm output circuit 108 and the desensitization circuitry activation switch 322 are mounted integrally within the smoke alarm housing, it is anticipated that applications will arise wherein it is convenient or desirous to locate the switch 322 or the alarm circuit 108 in a location remote from the smoke alarm housing. This is especially true when mounting the alarm on a ceiling or high on a wall to maximize its effectiveness in early detection of fires, since smoke is carried by warmer air which will rise to the higher levels of any confined space. The use of a remote switch advantageously enables a person to desensitize the smoke alarm without requiring the person to climb on a ladder or the like. If, in the alternative embodiments, the remote switch 322 is to be a long distance from the smoke detector, it may be advantageous to use a relay powered by an external source in place of switch 322. Use of such a relay would reduce the likelihood of excessive leakage current and also reduce the sensitivity of the circuit to extraneous noise. In additional embodiments, the circuit can include a remotely located signal generation mechanism so that an alarm will be sounded or otherwise indicated at the remote location.

In the preferred embodiment of FIG. 2, when the desensitization circuit is manually activated by closing of the switch 322, the voltage at the second external node 314 is forced to the supply voltage on the positive voltage bus 120 and the capacitor 318 is charged to the supply voltage. As a result, the first NPN transistor 308 is driven into saturation with the current into the first base supplied through the fourth sensitivity adjustment resistor 320. When the first NPN transistor 308 saturates, it operates as a closed semiconductor switch, and the voltage at its collector and thus the voltage on the first external node 304 is pulled to near the potential of the external ground reference 122, as determined by the collector-emitter saturation voltage of the first NPN transistor 308. The second NPN transistor 312 is then cut off since its base current is shunted to the ground reference 122 by the first NPN transistor 308. While the base emitter voltage of transistor 312 remains less than approximately 0.5 volt, only a small leakage current will flow in its collector circuit.

As a result of the saturation of the first NPN transistor 308, the second sensitivity adjustment resistor 302 is effectively placed in parallel with the first and second voltage divider network resistors 184, 188 between the second voltage divider node 190 and the external ground reference 122. The resistance of the second sensitivity adjustment resistor 302 is selected so that the voltage on the first voltage divider node 182 and the voltage on the second voltage divider node 190 are changed significantly. For example, in a preferred embodiment, the second sensitivity adjustment resistor 302 has a resistance of 150,000 ohms. This lowered voltage at the second voltage divider node 190 has the effect of causing the output of the battery voltage level sensing comparator 240 to change states as if a low battery voltage condition has occurred, resulting in an audibly sensible signal to the user (e.g., an activation of the horn 110 every 40 seconds) to indicate that the sensitivity reduction circuit is now active. The effect of the lowered voltage at the first voltage divider network node 182 causes a greater voltage decrease at the inverting input of the smoke-sensing comparator 180 from the inner electrode 148 of the detector's ionization chamber 104 to be required before a smoke alarm condition results. The overall sensitivity of the alarm is thus lowered, yet the circuit remains active and capable of detecting increased concentrations of smoke, as would result from an actual fire.

When the momentary contact switch 322 is released, the capacitor 318 initially remains charged to the magnitude of the supply voltage, and the first NPN transistor 308 is thus held in saturation. The capacitor 318 will begin to slowly discharge through the fourth sensitivity adjustment resistor 320 into the base of the first NPN transistor 308. As the capacitor 318 continues to discharge to ground, the voltage on the second external node 314 will decrease, and eventually the first NPN transistor 308 will no longer be driven into saturation, and will enter its active region. When this occurs, the voltage at the collector of the first NPN transistor 308 and thus on the first external node 304 will begin to increase from its saturation voltage of approximately 0.1 volt.

Simultaneously with the increasing voltage at the first external node 304, the base current increases to the second NPN transistor 312 through the third sensitivity adjustment resistor 310. As this increasing current into the base drives the second NPN transistor 312 into its active region, the timing capacitor 318 will begin to be discharged through the collector and emitter of the second NPN transistor 312. This, in turn, causes a further reduction of the voltage at node 314, thereby reducing the base current of the second NPN transistor 312, thus increasing the rate at which the voltage on the first external node 304 increases. The result is a very abrupt and regenerative condition where the first transistor 308 is very quickly turned off, the second transistor 312 is turned on to saturation, and the capacitor 318 is substantially fully discharged.

As a result, there will be a correspondingly abrupt increase of the voltage on the first external node 304, therefore causing voltage increases at the second voltage divider node 190 and the first voltage divider node 182. This abrupt voltage increase at the second voltage divider node 190 has the effect of removing the "low battery" indication at the output of the low battery comparator 240. Similarly, the voltage level is abruptly increased on the inverting input of the ionization voltage sensing comparator 180, thus increasing the voltage at which the output of the ionization voltage sensing comparator 180 will change states so that the sensitivity of the circuit to low-level concentrations of smoke or other particles is returned to the original level.

Stated differently, the first and second NPN transistors 308 and 312 form a feedback circuit that substantially decreases the time required to return the alarm circuit to full sensitivity after expiration of the predetermined time interval fixed by the selection of the magnitudes of the capacitor 318 and the fourth external resistor 320.

Figures 3, 4:
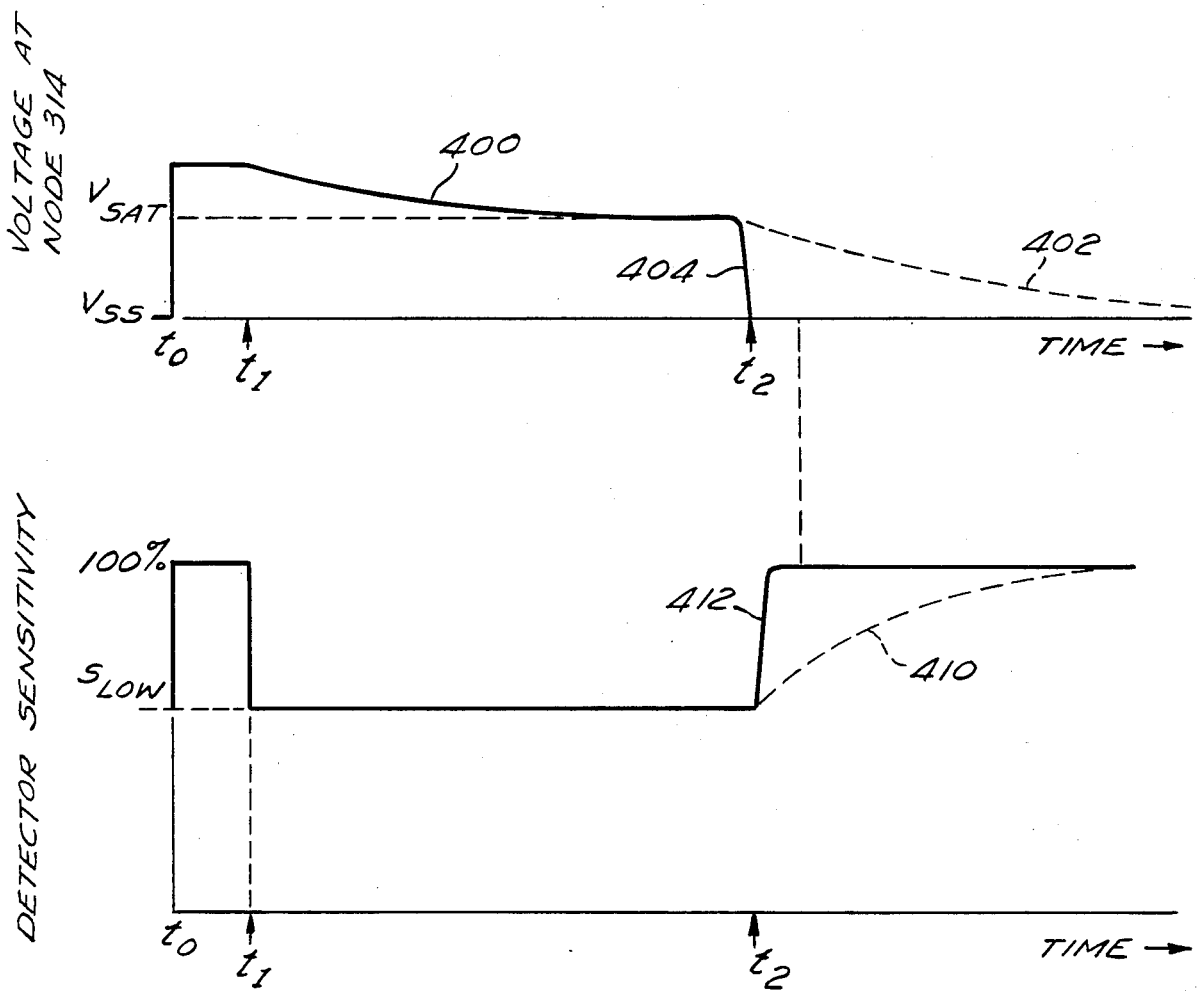
FIG. 3 is a graphical representation of the controlling voltage waveform on the time delay capacitor when the desensitization circuit is activated.
FIG. 4 is a graphical representation of the relative sensitivity of the smoke alarm to smoke conditions during operation.

The effect of the feedback circuit can be more fully understood by referring to FIGS. 3 and 4. FIG. 3 is a graph of the voltage on the second external node 314. At a time $t_0$, the capacitor is shown charged to the positive supply voltage (labeled as $V_{DD}$) by the activation of the momentary contact switch 322. At a time $t_1$, the momentary contact switch 322 is released, and the capacitor 318 will begin discharging exponentially as indicated approximately by a solid line 400. When the voltage at the node 314 reaches the minimum voltage required to maintain the first NPN transistor 308 in saturation, the voltage on the collector of the first NPN transistor 304 begins rising. This time is indicated as $t_2$ in FIG. 3. If the second NPN transistor 312 were not connected as described above, the capacitor 318 would continue to discharge exponentially as indicated by a dashed line 402. Instead, the feedback operation of the second NPN transistor 312 causes a sharp increase in the discharge rate as indicated by the solid line 404, causing the capacitor to rapidly become fully discharged to the saturation voltage of the second NPN transistor 312.

The time required for the transition from low sensitivity to high sensitivity is determined principally by the selection of values for the timing capacitor 318 and the fourth sensitivity adjustment resistor 320, but also by other factors such as the leakage current of capacitor 318, the actual current gain of the transistor 308, and the voltage to which capacitor 318 is originally charged. For example, a resistance of 680,000 ohms and a capacitance of 100 microfarads provides an exemplary time delay of roughly 10–15 minutes.

The sensitivity of the alarm circuit is illustrated graphically in FIG. 4. As illustrated, the maximum sensitivity is shown as 100%. When the momentary contact switch 332 is activated at time $t_0$, the sensitivity is reduced to a value less than 100% that is determined by the interaction of the second sensitivity adjustment resistor 302 with the internal voltage divider network of the integrated circuit 100. This reduced sensitivity is designated as $S_{LOW}$ in FIG. 4. The sensitivity remains at this reduced level until the time $t_2$, when the capacitor voltage is insufficient to maintain the first NPN transistor 308 in saturation. If the second NPN transistor 312 were not included in the circuit, the sensitivity would increase at an exponential rate illustrated by a dashed line 410. This rate is determined by the decaying exponential curve of the voltage of the capacitor 318, thus taking a relatively long period of time to restore the final increments of sensitivity. The addition of the second NPN transistor 314 provides a "snap action" of the circuit at the time $t_2$ and thus the sensitivity increases rapidly to a full 100% sensitivity as illustrated by a line 412.

In other words, if the feedback circuit of transistor 312 and resistor 310 were not present, then as resistor 308 began to come out of saturation, the voltage at node 304 would gradually rise from its saturated value of about 100 millivolts. Thus, in that case, the sensitivity of the alarm circuit would gradually begin to increase toward its original full sensitivity value as indicated by dotted line 410. As long as transistor 308 was conducting any appreciable current, the operating sensitivity would be less than its full value, and the voltage at capacitor 318 would continue to discharge at the exponential rate illustrated by dotted line 402.

Further, the omission of transistor 312 could create another problem because any leakage current across the switch 322, either at the switch 322 itself (which could be remote) or across the printed circuit board, could charge capacitor 318, turn on transistor 308 slightly, and decrease the operating sensitivity erroneously.

Instead, the feedback operation of the second NPN transistor 312, biased by resistor 310, as indicated by solid line 412, causes a very abrupt change in the operating sensitivity from its desensitized value back to the full sensitivity as soon as transistor 308 just comes out of saturation.

Now turning to the preferred embodiment shown in FIG. 5, all connections are identical with those previously described with respect to FIG. 2, except: (1) the second sensitivity adjustment resistor 302 is not connected between the second battery sensitivity adjustment pin 198 and the first external node 304, and therefore, the battery sensitivity adjustment pin 198 may be unconnected to any circuit outside the integrated circuit MC14466 previously described; and (2) the second sensitivity adjustment resistor 302 is connected, instead, between the first sensitivity adjustment pin 194 and the first external node 304.

Referring again to the preferred embodiment of FIG. 5, a typical resistance value for resistor 302 is 750,000 ohms, and that for resistor 320 is 620,000 ohms. All other resistance and capacitance values may by substantially similar with those of the preferred embodiment of FIG. 2.

The operation of the preferred embodiment of FIG. 5 is also similar to that of the preferred embodiment of FIG. 2, except that a reduction in voltage on external node 304, such as may be caused by closing switch 322 to desensitize the circuit, effectively places resistor 302 in parallel with both the variable resistor 239 and the voltage divider resistor 184. This results in a voltage reduction on the first external node 194, causing a decrease of the voltage on the non-inverting input of the ionization voltage sensing comparator 180, thereby decreasing the sensitivity of smoke detection (i.e., increasing the concentration of smoke required to activate the sensible output signal). Furthermore, a voltage reduction on the first voltage divider node 182 does not decrease the voltage at the second voltage divider node 192 to a voltage level sufficient to cause the battery voltage level sensing comparator 240 to change state. Therefore, in the embodiment of FIG. 5, no audibly sensible signal is produced unless the smoke concentration exceeds the temporary sensitivity level. In contrast, it should be remembered that the preferred embodiment of FIG. 2 produces an audibly sensible signal in response to the reduction of voltage on the second voltage divider node 192, thereby warning the user that the smoke detector is in its low sensitivity state. Some users may prefer to not have the audible sound during the low-sensitivity interval.

By connecting the external sensitivity circuit to pin 194 instead of pin 198, it is believed that the embodiment of FIG. 5 provides a greater predictability of sensitivity change as compared to the embodiment of FIG. 2. In the embodiment of FIG. 2, the variation of the resistance values internal to the MC14466 integrated circuit can more substantially affect sensitivity, causing a greater uncertainty regarding the duration of the period of decreased sensitivity as well as a greater uncertainty regarding the level of reduced sensitivity.

Although described above in connection with the preferred embodiment, one skilled in the art will understand that various changes and modifications can be made to the present invention without departing from the spirit thereof. Accordingly, the scope of the present invention is deemed to be limited only by the appended claims.

What is claimed is:

1. An electrically powered smoke alarm device, comprising:

a housing;

a smoke detector circuit within the housing that monitors the air proximate to the housing and that produces a sensible signal in response to detected smoke having a concentration in excess of a first level of concentration, said first level of concentration corresponding to a first sensitivity for said smoke detector;

means for connecting said smoke detector circuit to a source of electrical power; and a control circuit that temporarily reduces the sensitivity of the smoke detector circuit to the presence of smoke such that said sensible signal is produced only when smoke is detected in a second concentration which is in excess of the first level of concentration, and that automatically restores the sensitivity of the smoke detector circuit after the expiration of a predetermined time interval so that said smoke detector circuit detects the presence of smoke in excess of said first level of concentration.

2. An electrically powered smoke alarm, comprising:

a housing;

a smoke detector circuit mounted within said housing that monitors the concentration of smoke in the air proximate to said housing and provides a sensible output signal when said smoke concentration exceeds a selectable level of smoke concentration, said smoke detector circuit including a sensitivity adjustment input connection for adjusting the selectable level of smoke concentration at which said smoke detector circuit provides said sensible output signal;

means for electrically connecting said smoke detector circuit to a source of electrical energy;

a manually actuated switch electrically connected to said smoke detector circuitry; and a control circuit electrically connected to said sensitivity adjustment input connection of said smoke detector circuit and electrically connected to said manually actuated switch, said control circuit operable in a first state to provide a first input to said sensitivity adjustment input connection to cause said smoke detector circuit to have a first sensitivity and to provide said sensible output when said smoke concentration exceeds a first selectable level of concentration, said control circuit operable in a second state in response to the actuation of said switch to provide a second input to said sensitivity adjustment input connection to cause said smoke detector circuit to have a second sensitivity and to provide a sensible output when said smoke concentration exceeds a second selectable level of concentration greater than said first selectable level of concentration, said control circuit automatically returning to said first state a predetermined amount of time after the actuation of said switch to cause the sensitivity of said smoke detector circuit to return to said first sensitivity.

3. The smoke alarm as defined in claim 2, wherein said smoke detector circuit includes a voltage divider network connected between first and second voltage references, said voltage divider network providing a sensitivity reference voltage that determines the sensitivity of said smoke detector circuit, and wherein said control circuit is operable in said second state to electrically interconnect a resistor in parallel with said voltage divider network to reduce said sensitivity reference voltage.

4. The smoke alarm as defined in claim 3, wherein said control circuit further includes a semiconductor switch that is operable in said second state to provide a current path from said sensitivity adjustment input connection through said resistor and to said second voltage reference.

5. The smoke alarm as defined in claim 4, further including a timing capacitor electrically connected to control said semiconductor switch, said capacitor having a first voltage when said manually actuated switch is actuated, said capacitor having a second voltage a predetermined time after said manually actuated switch is activated, said semiconductor switch conducting in response to said first voltage on said capacitor to provide said current path through said resistor, said semiconductor switch non-conducting in response to said second voltage on said capacitor to disconnect said current path through said resistor.

6. The smoke alarm as defined in claim 5, further including a feedback circuit from said semiconductor switch to said capacitor so that said capacitor has a first rate of change in voltage as said capacitor voltage changes from said first voltage to said second voltage and has a second rate of change of voltage greater than said first rate of change of voltage when said capacitor voltage approaches said second voltage so that said semiconductor switch rapidly changes from its conducting state to its nonconducting state.

7. The smoke alarm as defined in claim 2, wherein said smoke detector circuit includes first and second voltage references, and wherein said control circuit comprises:

a first node and a second node; a first resistor electrically connected between said first node and said sensitivity adjustment input of said smoke detector circuit;

a first transistor electrically connected between said first node and said second voltage reference;

a second resistor electrically connected between the base of said first transistor and said second node; and a timing capacitor electrically connected between said second node and said second voltage reference, said manually actuated switch electrically connected between said second node and said first voltage reference, said capacitor operable in response to actuation of said manually actuated switch to change the voltage on said second node to the voltage on said first voltage reference, and thereafter to slowly change said voltage on said second node towards the voltage of said second voltage reference, said first transistor saturating when the voltage on said second node is near the voltage of said first voltage reference to provide a low impedance current path from said first node to said second voltage reference.

8. The smoke alarm as defined in claim 7, further comprising a second transistor electrically connected between said second node and said second voltage reference, and a third resistor electrically interconnecting the base of said second transistor to said first node, said second transistor and said third resistor operable as a feedback circuit to rapidly discharge said timing capacitor when the voltage on said second node is insufficient to maintain said first transistor in saturation.

9. The smoke alarm circuit as defined in claim 2, wherein said smoke detector circuit comprises an integrated circuit and ionization chamber.

10. The smoke alarm circuit as defined in claim 9, wherein the integrated circuit is a Motorola MC14466 integrated circuit.

11. The smoke alarm circuit as defined in claim 9, wherein the integrated circuit is a Motorola MC14467 integrated circuit.

12. The smoke alarm circuit as defined in claim 9, wherein said smoke alarm comprises a means for producing a low battery sensible signal, said means including a battery voltage level comparator within said integrated circuit, and wherein said sensitivity adjustment input connection is electrically connected to said battery voltage level comparator so that the low battery sensible signal is produced during a time interval in which the smoke alarm is in said second state, whereby the user is sensibly informed that the smoke alarm device is monitoring smoke at said second sensitivity level during this time interval.

13. The smoke alarm circuit as defined in claim 2, wherein in the second state, a reduced sensitivity sensible signal is provided whereby the user is sensibly informed that the smoke alarm is monitoring smoke at said second sensitivity level.

14. In an electrically powered smoke alarm device having a smoke detector circuit that monitors the air proximate to the smoke detector circuit and that produces a predetermined sensible signal in response to detected smoke in excess of a first level of smoke concentration, corresponding to a first sensitivity for said smoke alarm device, said smoke detector circuit having a sensitivity adjustment input responsive to a selectable input condition, a method of reducing the sensitivity of said smoke detector circuit to a second sensitivity so that said smoke detector circuit produces said predetermined sensible signal only in response to a second level of smoke concentration in excess of said first level of smoke concentration, said method comprising the steps of:

selectively initiating a timing circuit that generates a predetermined timing interval;

electrically connecting a selected input condition to said sensitivity adjustment input of said smoke detector circuit during said predetermined timing interval so that the sensitivity of said smoke detector circuit is decreased to said second sensitivity during said timing interval; and electrically disconnecting said selected input condition from said sensitivity adjustment input of said smoke detector circuit at the conclusion of said predetermined timing interval so that the sensitivity of said smoke detector circuit returns to said first level of sensitivity.

* * * * *